United States Patent [19]

Piesik

[11] Patent Number: 4,686,884

[45] Date of Patent: Aug. 18, 1987

[54] GAS MANAGEMENT DEFLECTOR

[75] Inventor: Edward T. Piesik, Pomona, Calif.

[73] Assignee: General Dynamics, Pomona Division, Pomona, Calif.

[21] Appl. No.: 813,906

[22] Filed: Dec. 27, 1985

[51] Int. Cl.[4] ..... F41F 3/04

[52] U.S. Cl. ..... 89/1.816; 89/1.8; 89/1.812

[58] Field of Search ..... 89/1.816, 1.812, 1.8; 244/114 B

[56] References Cited

U.S. PATENT DOCUMENTS

| | | | |
|---|---|---|---|
| 2,445,423 | 7/1948 | Eastman | 89/1.8 |
| 3,052,303 | 9/1962 | Lapp | 89/1.8 X |
| 3,081,970 | 3/1963 | Einarsson | 244/114 B |
| 3,228,296 | 1/1966 | Neuman et al. | 89/1.8 |
| 3,436,036 | 4/1969 | Madelung | 244/114 B |
| 3,645,478 | 2/1972 | Madelung | 244/114 B |
| 4,044,648 | 8/1977 | Piesik | 89/1.816 X |
| 4,134,327 | 1/1979 | Piesik | 89/1.816 X |
| 4,173,919 | 11/1979 | Piesik | 89/1.816 X |
| 4,186,647 | 2/1980 | Piesik | 89/1.816 X |
| 4,324,167 | 4/1982 | Piesik | 89/1.812 X |
| 4,373,420 | 2/1983 | Piesik | 89/1.812 |
| 4,433,606 | 2/1984 | Hagelberg et al. | 89/1.812 |

*Primary Examiner*—David H. Brown

*Attorney, Agent, or Firm*—Henry M. Bissell; Edward B. Johnson

[57] ABSTRACT

Pivotable deflector panels are installed in the transition sections between a plurality of rocket storage and launch chambers and a lower plenum or manifold chamber which is provided to dispose of the exhaust gases from missile firings. The deflector panels are in addition to the sets of doors which are provided to close off the missile storage chambers upon the firing of a missile in another chamber in order to prevent recirculation of exhaust gases into the closed off chambers. The deflector panels act with the doors to control exhaust gas flow, thereby improving the effectiveness of the gas plug which is formed by exhaust gases within a transition section.

19 Claims, 6 Drawing Figures

Fig. 1 - Prior Art

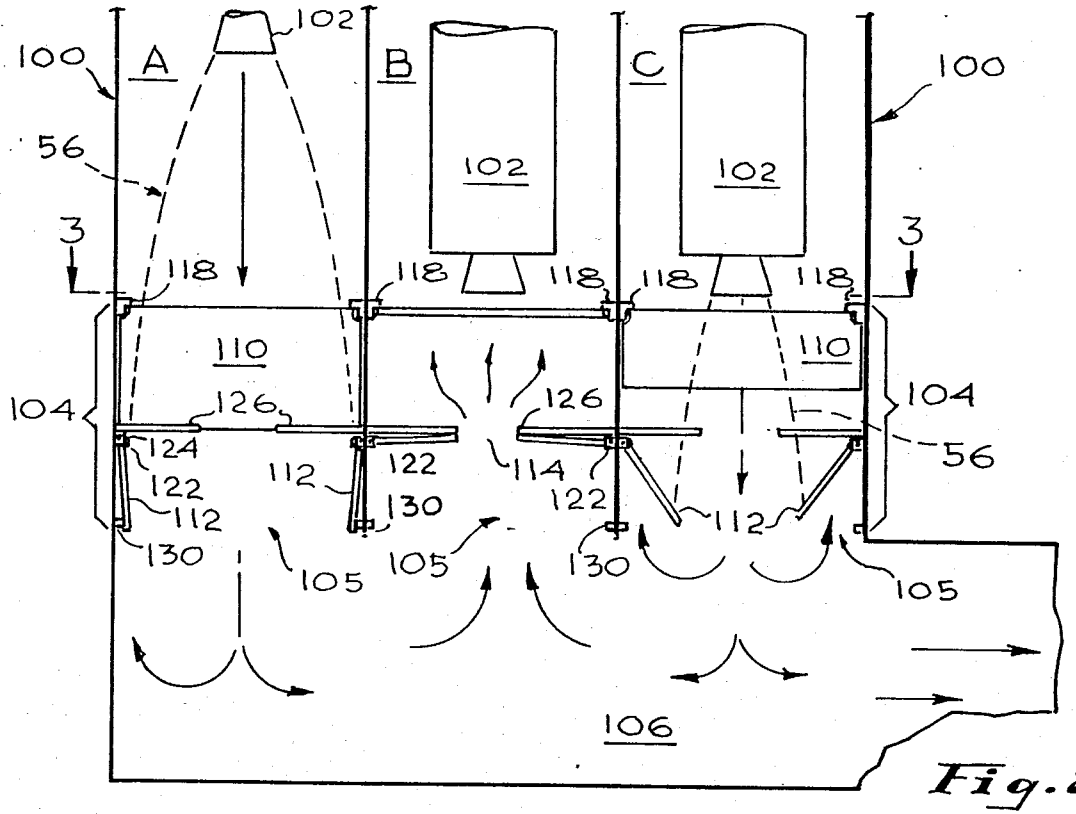
Fig. 2
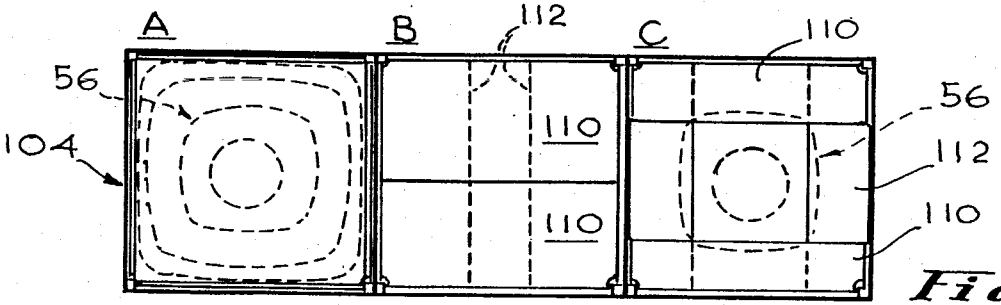
Fig. 3
Fig. 4
Fig. 5A
Fig. 5B

GAS MANAGEMENT DEFLECTOR

BACKGROUND OF THE INVENTION

1. Field of the Invention

The present invention relates to the field of controlled flow, exhaust manifold systems and, more particularly, to apparatus for controlling the flow of exhaust gases between a plurality of rocket storage and launch stations and a common exhaust gas manifold or plenum tube connected thereto.

2. Description of the Prior Art

In certain military applications, particularly on warships having missile firing capability, the missiles are stored in a series of vertically oriented chambers closely adjacent one another. Exhaust gas outlets are normally provided to duct rocket exhaust gases generated during intended or accidental rocket ignitions to a safe location. In such installations, manifolding of a number of chambers into a common exhaust duct or plenum tube is often necessary.

There have been a number of approaches to the problems attendant upon the use of a common exhaust duct with a number of missile storage chambers. It is important to be able to block the exhaust gases from a missile which is being fired from blowing out the individual chambers of other missiles. This is commonly accomplished by the use of doors or hinged panels which can open from the force of an impinging missile exhaust for the chamber in which the missile being fired is located and close off the passage at the base of a missile chamber opening into the exhaust plenum for other missiles.

The disclosures, for example, of Eastman U.S. Pat. No. 2,445,423 and Neuman et al U.S. Pat. No. 3,228,296 illustrate the use of doors or valves for this purpose. However, the arrangement of Neuman et al appears to involve a non-hinged "blow out" door which, when a particular rocket is fired, is blown out of its opening to admit gases from the chamber of the firing rocket into the manifold. A particular disadvantage with respect to this system relates to the apparent failure to provide any arrangement for automatically re-closing the door. Moreover, little consideration appears to have been given to preventing recirculation of exhaust gases back into and through a chamber while a rocket is firing in that chamber.

The Eastman patent discloses apparatus including hinged, spring-loaded doors which open for a rocket that is being fired and serve to confine the exhaust gases within the plenum chamber and away from the other missile storage chambers.

My own prior U.S. Pat. No. 4,044,648, the entire disclosure of which is incorporated by reference as though fully set forth herein, discloses a pair of hinged doors at the base of each missile storage chamber in the passage connecting the chamber to an associated exhaust plenum duct. The pressure forces on opposite sides of the doors during the firing of a missile are balanced to control the degree to which the doors are opened in order to adjust the opening to the varying dimension of the rocket exhaust stream as the missile rises and leaves the chamber upon firing. As a consequence, the rocket exhaust stream functions as a suitable "gas plug" in the opening in order to prevent recirculation of the exhaust gases back into the chamber.

It is important to control the rocket exhaust gas stream so that the gas plug is effective to prevent recirculation of exhaust gases back into the chamber. Control of the rocket exhaust stream on a dynamic basis to develop the gas plug effect appears to be more effective for the intended purpose than the use of fixed structure such as baffles, valves, diverters or the like which oftentimes have the undesirable result of interfering with the direct exhaust gas stream in their attempt to control flow, limit reverse circulation, etc.

Some of my other patents which are of interest herein because of their disclosures of doors or covers for the ends of rocket launch tubes are U.S. Pat.Nos. 4,134,327, 4,173,919, 4,186,647 and 4,324,167.

In addition to the patents cited above, applicant is aware of the following patents which relate to diverter apparatus for vertical take-off and landing (VTOL) aircraft: British patent No. 886,330; Madelung U.S. Pat. Nos. 3,436,036 and 3,645,478; and Einarsson U.S. Pat. No. 3,081,970. There is also a Lapp U.S. Pat. No. 3,052,303 which discloses an automatic fire extinguishing system directed to automatically extinguishing the solid fuel grain of a rocket which may have been ignited accidentally. These patent disclosures bear little relationship to the present invention.

SUMMARY OF THE INVENTION

In brief, arrangements in accordance with the present invention incorporate a pair of hinged doors for closing off the passage between a missile chamber and the plenum together with a pair of hinged deflector panels situated below the doors near the outlet of the passage. The principal effect of these deflector panels is to limit the plenum recirculating backflow and, further, to cooperate with the doors to dynamically control the exhaust gas flow and improve the effectiveness of the exhaust gas plug in preventing plenum recirculating backflow. The articulating deflector panels are movable between vertical and horizontal positions, together with the hinged doors, to interact dynamically with the exhaust gas stream. In this manner, a certain gas plug area will be formed, upon firing, when the rocket is at rest. This gas plug area changes as the chamber pressure of the rocket varies during movement up through the launch tube, and the generally square cross sectional area becomes a maximum as the rocket distance increases. The hinge axes of the articulating deflector panels are preferably at right angles to hinge axes of the rocket chamber doors, and the deflector panels, when in the fully horizontal position, do not entirely close off the passage. Both the deflector panels and the missile chamber doors seek, in concert, angular positions (between the horizontal and vertical orientations) that are balanced by the exhaust impingement pressure on the rocket side of the doors or panels and the plenum backflow pressure on the bottom sides of the doors or panels.

The design of an appropriate set of control doors and deflector panels, together with the transition section which extends from the missile chamber to the plenum, and in which the doors and panels are mounted, requires consideration of the following parameters: the ballistic values of the rocket motor (including chamber pressure, flow rate, combustion temperature and throat diameter), the cross sectional flow area of the missile storage chamber, the maximum chamber design pressure during normal launch, the cross sectional flow area of the plenum or manifold, the pressure in the manifold which results from a maximum exhaust flow rate, the allowable height of the transition section, and a theoretical or experimental description of the rocket exhaust flow field as a function of time and axial and radial directions (the required flow elements being: pitot pressure, static pressure or local ambient pressure, static temperature, total temperature, velocity, Mach number, gas constant, and specific heat ratio). One particular exemplary design for a pair of control doors and a transition section is described in my U.S. Pat. No. 4,044,648.

BRIEF DESCRIPTION OF THE DRAWING

A better understanding of the present invention may be had from a consideration of the following detailed description, taken in conjunction with the accompanying drawings in which:

FIG. 2 is a corresponding schematic diagram of one particular arrangement in accordance with the present invention;

FIG. 3 is a sectional view looking downward, taken along the line 3—3 of FIG. 2;

FIG. 4 is an end view, in section, of the arrangement of FIG. 2; and

FIGS. 5A and 5B depict alternative arrangements of portions of the arrangement of FIG. 2.

DESCRIPTION OF THE PREFERRED EMBODIMENTS

Figure 1:
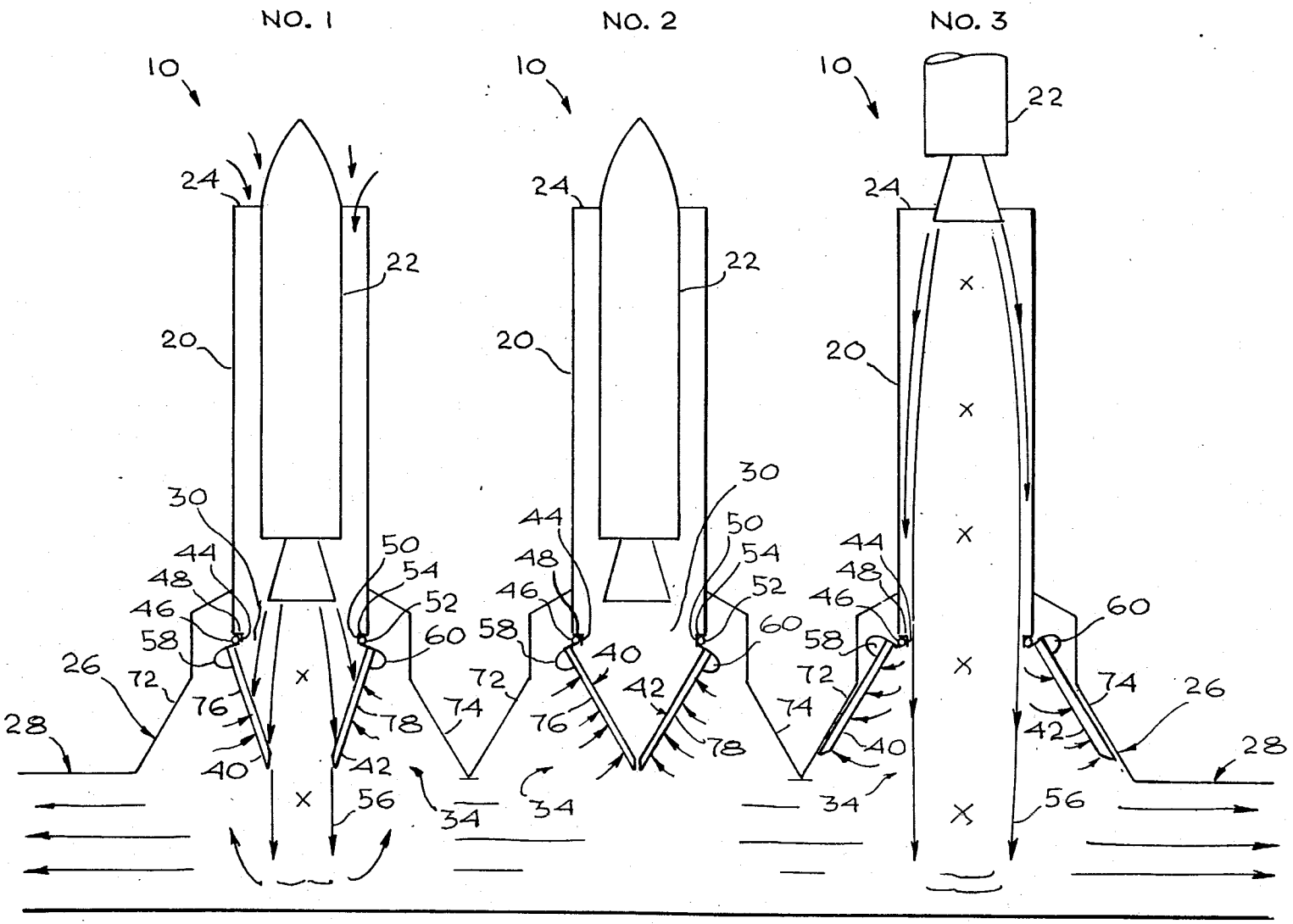
FIG. 1 is a schematic elevational diagram showing a plurality of missile storage chambers and associated plenum system of my prior patent U.S. Pat. No. 4,044,648.

Referring to FIG. 1, which is a schematic representation of a plurality of individual missile storage chambers coupled in the plenum system of my prior patent, the drawing shows a plurality of stations 10 connected to a common manifold or plenum 28. Each station 10 comprises a rocket storage chamber 20 having an upper opening 24 and a bottom opening 30 communicating with a transition section 26 that opens into the manifold 28. A missile 22 is stored in each individual chamber 20. For purposes of illustration, the missiles 22 in FIG. 1 are shown in various stages of storage and launch.

The bottom opening 30 is normally closed by a pair of angled doors or panels 40, 42 which are pivotably attached along an upper, inner edge 44 by hinge 46 to an inwardly projecting first edge portion 48 of the transition section 26. Similarly, the door 42 is pivotably attached along an opposing upper, inner edge 50 by a hinge 52 to an opposite, inwardly projecting second edge portion 54 of the transition section 26.

The doors 40 and 42, in the case of the No. 2 chamber 20 containing an unfired missile 22, pivot closed under the action of pressure in the manifold 28 when a missile in another chamber is being fired. This prevents exhaust gases from flowing from the manifold 28 upwardly through the transition section 26 and into the chamber 20. The doors 40 and 42 pivot open, under the combined action of pressure in the manifold 28 and pressure of exhaust gases emitted from the rocket 22 when it fires, by an amount to allow the exhaust stream 56 (at stations Nos. 1 and 3) flowing downwardly between the open doors to function as a gas plug preventing the flow of exhaust gases from the manifold 28 back through the doors and upwardly into the chamber 20.

The doors 40, 42 are counterbalanced by weights 58, 60, respectively, affixed to upper, outer portions of the doors. To permit the complete opening of the doors 40, 42, the transition section 26 is formed in a trapezoidal configuration, with lower portions of end walls 72, 74 of the transition section being inclined outwardly from the vertical along the axis of the manifold.

During the firing of a rocket 22, gas flow and the resultant forces are generally as indicated by the arrows. For a chamber containing an unfired missile or for one in which firing has just been initiated, the recirculating gas from a missile being launched exerts forces against the outer surfaces 76, 78 of the doors 40, 42. This maintains the doors firmly closed for an unfired missile chamber, as in No. 2, and tends to counterbalance the forces of the rocket exhaust for a missile during initial firing, as in No. 1. As a result, the doors 40, 42 of chamber No. 1 are only partially opened, thereby tending to establish the exhaust gas plug which prevents recirculation of exhaust gases up into the chamber of the missile being fired. The problem with the effectiveness of the exhaust gas plug in this particular configuration results from the generally planar shape of the two doors 40, 42 making up the bottom closure for the chamber. While these doors effectively block recirculating exhaust gases in the plane of the drawing of FIG. 1, they are less effective in preventing recirculation of exhaust gases in a plane perpendicular to the plane of the drawing of FIG. 1.

An improved gas management system in accordance with the present invention is schematically represented in FIGS. 2, 3 and 4. These figures show three missile chambers 100, designated A, B and C, in which for purposes of illustration a plurality of missiles 102 are shown in various stages of storage, ignition and launch. At the bottom of each chamber 100 is a transition section 104 which extends generally from the end of the exhaust nozzle of the rocket 102 in the stored position to an opening 105 which communicates with the plenum or manifold 106. A plurality of hinged panels is located within each transition section 104 to control the exhaust gases from a missile 102 by permitting gases from a missile being fired to exit into the manifold 106 while blocking recirculation of exhaust gases from the manifold 106 up into the rocket chambers. In controlling the rocket exhaust gases in this manner, the panels adjust to the dimension of the rocket exhaust gases, which varies as the rocket during launch proceeds up the chamber 100 away from the transition section 104. In so controlling the rocket exhaust gases, the panels effectively shape the cross section of the gas plug to match the opening which is provided, thereby blocking the recirculation of exhaust gases back up into the chamber of the rocket being fired.

The panels in each transition section 104 are of two types: a pair of upper doors 110, each of which is pivoted to swing in a first plane between open and closed positions, and a pair of deflector panels 112. When closed, the doors 110 essentially completely close off the bottom opening of the chamber 100.

The deflector panels 112 are mounted below the doors 110 and each is hinged to pivot in a second plane which is orthogonal to the pivots of the doors 110. The deflector panels 112 do not entirely close off the opening in the transition passage 104 when they are in the closed position. Instead, a partial opening 114 is maintained to permit some exhaust gases from the plenum 106 to flow upwardly and apply a closing pressure force against the doors 110.

In the embodiments shown, the doors 110 are suspended by pivot pins 116 from support brackets 118. Similar pivot pins 122 and brackets 124 pivotably support the deflector panels 112. Stop members in the form of bars 126 and 128 are mounted along the sides of the transition section 104 to limit the upward travel of the deflector panels and control doors, respectively. The aligned bars 126 do not extend all the way across a side of the transition section 104 but are interrupted near the center. As shown in FIG. 4, the bars 126 also serve to space the doors 110 away from the sides of the transition chamber 104, and the gaps along the central sections of the bars 126 permit gas pressure to develop behind the doors 110 when a missile in another chamber is firing and sending exhaust gases down into the plenum 106. Thus, the doors 110 are permitted to hang downward when no missile is firing but are assured of being raised to the closed position as soon as the firing of a missile develops pressure in the plenum 106. This arrangement obviates the need for springs or counterweight arrangements to close the doors. Similar elements 130 in the form of spacers behind the deflector panels 112 are provided for a similar purpose, thereby assuring that the deflector panels 112 pivot out of their vertical rest position as soon as a missile firing develops pressure in the plenum 106.

Alternative arrangements which may be employed to establish back pressure behind the hanging panels 110, 112 are illustrated in FIGS. 5A and 5B. FIG. 5A illustrates a member 140, which may be either a door 110 or a panel 112, or it may represent a portion of wall of the transition section 104. One surface 142 of the member 140 is corrugated with a plurality of vertically aligned slots 144 as shown. The slots 144 are arranged along the surface 142 on the back side of the panel or door 110, 112, if the member 140 is such an element. On the other hand if the member 140 is a wall portion of a transition section 104, the grooves or slots 144 are on the surface 142 facing inwardly, toward the hanging door or panel 110, 112.

A similar member 140' having a surface 142' is shown in FIG. 5B. This is like the member 140 of FIG. 5A with the exception that the surface 142' is provided with a hollowed concave shape 146 which is oriented so that pressure forces can enter the region 146 from the lower edge adjacent the plenum chamber 106. As with the member 140 of FIG. 5A, the member 140' can comprise the doors and panels 110, 112 or the wall portions of the transition section 104.

The effect of the panel and door arrangement of the present invention on the exhaust gas plume is best shown in FIG. 3. For chamber C, where the missile has just been fired but has not yet begun to leave the chamber, the doors 110 and deflector panels 112 are shown in approximately 45° elevated position, as indicated in FIG. 2. The effect of these elements in shaping the rocket exhaust plume is clearly apparent and the resultant gas plug is seen effectively totally enclosing the central opening of the transition section 104. Were it not for the deflector panels 112, the exhaust plume would not be as effective in closing off the transition section along the edges where the deflector panels are mounted. Chamber A in FIG. 3 shows how the gas plug is expanded to substantially fill the opening of the transition section 104 as the missile being launched moves upward in the chamber, thereby forcing the deflector panels 112 and the doors 110 substantially fully open.

Thus it may be seen that the pivoted deflector panels 112 which are provided in addition to, and at right angles to, the doors 110 in the transition section 104 advantageously serve to control the exhaust gases of a missile being fired to form an effective gas plug for blocking the recirculation of gases up into the associated missile storage chamber. This arrangement is effective to close off the bottom opening of all chambers other than the chamber in which a missile is being fired and also to vary the effective size of the bottom opening of the chamber where a missile is being fired, depending upon the position of the missile in the chamber as it moves upward from ignition to completed launch. By balancing the pressure forces which develop when a missile is fired, the apparatus of the present invention permits the deflector panels and doors to hang downwardly in a relaxed position until a missile is fired, at which point pressure forces are directed behind the doors and panels to raise them either to the closed position for a firing in another chamber or to particular orientations which optimally balance the forces of the internal exhaust gas pressure for a chamber undergoing a missile firing. These arrangements of the present invention obviate the need for springs, counterbalance weights, or other special structural elements which have been used in prior art arrangements for controlling the position of the closure doors, resulting in a simpler, more rugged and maintenance-free structure.

Although there have been described above specific arrangements of a gas management deflector in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. Apparatus for controlling the flow of exhaust gases of missiles in a plurality of missile storage chambers during firing of a missile comprising:

a plurality of missile storage chambers oriented generally adjacent one another;

a plenum chamber extending generally along the bottom of said storage chambers and coupled thereto for disposing of exhaust gases generated in said chambers by the firing of a missile therein; and a plurality of transition sections, one for each chamber, extending between respective chambers and the plenum chamber, each transition section including:

(a) a pair of doors pivotably mounted on a first pair of opposite sides of the transition section adjacent the juncture of the transition section with its associated chamber, said doors being pivotable between open and closed positions in response to gas pressure forces generated during the firing of a missile, said doors when in the closed position serving to close off the transverse bottom opening of the chamber; and (b) a pair of deflector panels pivotably mounted on the other pair of opposed sides of the transition section in a position below the doors, said deflector panels being effective in cooperation with said doors to direct the exhaust gases of a missile being fired to form a gas plug effectively preventing the recirculation of gases back into said chamber as the missile moves upward in said chamber during launch.

2. The apparatus of claim 1 wherein said doors have a width which is approximately one-half the transverse dimension of the transition section where the doors are mounted in order that the doors, when closed, substantially completely close off the opening in the transition section, and wherein the width of the deflector panels is substantially less than one-half the transverse dimension of the transition section where the deflector panels are mounted in order that the deflector panels, when in the closed position, leave a substantial gap between adjacent edges of the deflector panels to permit gases from the plenum to reach the doors.

3. The apparatus of claim 2 further including two sets of stop elements, one set associated with the doors and the other set associated with the deflector panels, said elements being positioned to limit the travel of the doors and panels past a midpoint position.

4. The apparatus of claim 3 wherein the stop elements associated with the doors are positioned to prevent the doors from moving past a closed position in the upward direction.

5. The apparatus of claim 3 further including means for developing back pressure forces from exhaust gas pressure in the plenum chamber behind the doors and panels when they are pivoted to the open position in order to urge said doors and panels toward the closed position.

6. The apparatus of claim 5 wherein said means comprise a first plurality of spacing members mounted along opposed sides of the transition section in line with the doors and positioned to contact the ends of the doors when in the open position to define spaces between the doors and the sides of the transition section.

7. The apparatus of claim 6 wherein said members are spaced apart to define gaps between members on the same side of the transition section to allow gases from the plenum chamber due to the firing of a missile to apply pressure forces behind the doors and elevate them toward the closed position.

8. The apparatus of claim 6 wherein said spacing members are integrally formed with the stop elements associated with the deflector panels.

9. The apparatus of claim 6 wherein said spacing members are integrally formed with the mounts for the deflector panels.

10. The apparatus of claim 6 further including a second plurality of spacing members mounted along opposed sides of the transition section in line with the deflector panels and positioned to contact the ends of the deflector panels when in the open position to define spaces between the deflector panels and the sides of the transition section.

11. The apparatus of claim 10 wherein the spacing members of said second plurality are separated to define gaps between members on the same side of a transition section to allow gases from the plenum chamber due to the firing of a missile to apply pressure forces behind the deflector panels and elevate them toward a position extending transversely of the transition section.

12. The apparatus of claim 6 wherein said means comprise contoured surfaces on the back sides of the doors and panels which are shaped to define vertically oriented spaces for receiving back pressure from the plenum chamber when a missile is being fired in another storage chamber.

13. The apparatus of claim 12 wherein said contoured surfaces define a plurality of vertically aligned slots.

14. The apparatus of claim 12 wherein said contoured surfaces are corrugated.

15. The apparatus of claim 12 wherein said contoured surfaces are concave.

16. The apparatus of claim 6 wherein said means comprise wall portions of the transition sections, said wall portions having inwardly facing surfaces which are shaped to define spaces for receiving back pressure from the plenum chamber when a missile is being fired in another storage chamber.

17. The apparatus of claim 16 wherein said contoured surfaces define a plurality of vertically aligned slots.

18. The apparatus of claim 16 wherein said contoured surfaces are corrugated.

19. The apparatus of claim 16 wherein said contoured surfaces are concave.

* * * * *